US011149464B2

(12) United States Patent
Baskett

(10) Patent No.: US 11,149,464 B2
(45) Date of Patent: Oct. 19, 2021

(54) PALAPA CANOPY COLLAPSIBLE FRAME

(71) Applicant: Paradise Grilling Systems, Inc., Orlando, FL (US)

(72) Inventor: Raymond Baskett, Orlando, FL (US)

( * ) Notice: Subject to any disclaimer, the term of this patent is extended or adjusted under 35 U.S.C. 154(b) by 4 days.

(21) Appl. No.: 16/663,968

(22) Filed: Oct. 25, 2019

(65) Prior Publication Data

US 2020/0141152 A1 May 7, 2020

Related U.S. Application Data

(60) Provisional application No. 62/754,660, filed on Nov. 2, 2018.

(51) Int. Cl.

| | |
|---|---|
| ***E04H 15/48*** | (2006.01) |
| ***E04H 15/28*** | (2006.01) |
| ***A47F 9/00*** | (2006.01) |
| ***E04H 1/12*** | (2006.01) |

(52) U.S. Cl.

CPC ..... *E04H 15/48* (2013.01); *A47F 9/00* (2013.01); *E04H 15/28* (2013.01); *E04H 1/1222* (2013.01)

(58) Field of Classification Search

CPC ..... E04H 15/02; E04H 15/28; E04H 15/48; E04H 15/58; A45B 2019/005; A45B 2023/0093; A45B 2023/0025; A45B 2200/1063; A45B 2200/1009; A47F 9/00; A47F 10/00

See application file for complete search history.

(56) References Cited

U.S. PATENT DOCUMENTS

| | | | | | |
|---|---|---|---|---|---|
| 1,219,847 | A * | 3/1917 | Nettenstrom | E04H 15/28 | 135/98 |
| 1,449,894 | A * | 3/1923 | Dial | E04H 15/28 | 135/98 |
| 2,530,765 | A | 11/1950 | Greenup | | |
| 3,455,310 | A | 7/1969 | Petersen | | |
| 3,626,958 | A * | 12/1971 | Ross | E04H 15/28 | 135/98 |
| 4,947,884 | A | 8/1990 | Lynch | | |
| 5,490,533 | A | 2/1996 | Carter | | |
| 6,283,136 | B1 | 9/2001 | Chen | | |
| 6,692,135 | B2 | 2/2004 | Li | | |
| 6,745,521 | B1 | 6/2004 | Gazebo | | |
| 6,802,325 | B1 | 10/2004 | Apple | | |
| 6,918,640 | B2 * | 7/2005 | DeMars | A47B 77/10 | 312/140.2 |
| 7,052,062 | B2 * | 5/2006 | Catt | A47F 9/00 | 222/610 |
| 7,101,000 | B2 * | 9/2006 | DeMars | A47F 9/00 | 108/50.12 |
| 7,111,633 | B2 | 9/2006 | Moroney | | |

(Continued)

*Primary Examiner* — David R Dunn
*Assistant Examiner* — Danielle Jackson
(74) *Attorney, Agent, or Firm* — Wolter Van Dyke Davis, PLLC; Robert L. Wolter

(57) ABSTRACT

A palapa canopy collapsible frame including a cylindrical central support hub, a plurality of first frame members and second frame members pivotally connected to the cylindrical central support hub, and a plurality of vertical post connected to the first frame members. Each of the vertical posts including cross bar members that secure the vertical post to an adjacent first frame member.

8 Claims, 6 Drawing Sheets

(56) References Cited

U.S. PATENT DOCUMENTS

| | | | | |
|---|---|---|---|---|
| 7,273,261 | B2 * | 9/2007 | DeMars | A47F 9/00 108/115 |
| 7,314,055 | B2 | 1/2008 | Guo et al. | |
| 7,350,532 | B2 | 4/2008 | Wu | |
| 7,354,120 | B2 * | 4/2008 | DeMars | A47F 9/00 126/25 R |
| 7,451,776 | B2 | 11/2008 | Chen | |
| 7,509,967 | B2 | 3/2009 | Kim | |
| 8,016,371 | B2 * | 9/2011 | DeMars | A47F 9/00 312/140.2 |
| 8,267,490 | B2 * | 9/2012 | DeMars | A47F 9/00 312/258 |
| 8,740,318 | B2 * | 6/2014 | DeMars | E04H 1/1222 312/140.2 |
| 9,528,292 | B1 | 12/2016 | Lovley, II et al. | |
| 9,717,350 | B2 * | 8/2017 | DeMars | E04H 1/1222 |
| 9,790,705 | B2 | 10/2017 | Lyon | |
| 9,924,768 | B1 | 3/2018 | Rosenberger et al. | |
| 10,077,573 | B1 * | 9/2018 | Slaughter | E04H 15/58 |
| 2002/0046508 | A1 * | 4/2002 | Lekhtman | A47F 9/00 52/36.1 |
| 2004/0060588 | A1 * | 4/2004 | Lekhtman | A47F 9/00 135/98 |
| 2005/0011134 | A1 * | 1/2005 | Boltan | E04H 15/003 52/3 |
| 2012/0311954 | A1 | 12/2012 | Pili | |
| 2015/0247339 | A1 | 9/2015 | Lee | |
| 2016/0222693 | A1 | 8/2016 | Arndt et al. | |
| 2018/0106066 | A1 | 4/2018 | Choi | |
| 2018/0216362 | A1 | 8/2018 | Carter | |
| 2019/0085585 | A1 * | 3/2019 | Pomerantz | E04B 1/34315 |

* cited by examiner

PALAPA CANOPY COLLAPSIBLE FRAME

BACKGROUND OF THE INVENTION

This invention relates generally to the field of outdoor furniture, and more particularly to the canopy frames used to provide support for the coverings and thatching that protect outdoor areas from the elements.

Outdoor kitchens have become increasingly popular over the past several years. To that end, some of the kitchen components and assembly have become extremely sophisticated including outdoor grills, refrigerators, wet bars, sound systems, etc. Some outdoor kitchens are designed and decorated in a variety of ways and towards specific themes depending on the user's preference. By way of example, some kitchens may include a palapa canopy, more commonly known as a tiki hut.

The construction of traditional palapas can become very involved as these structures can have sophisticated truss systems to support the thatch canopy. In addition, to the extent the palapa may be considered a permanent structure, building permits may be required for building and installation. Another drawback is that the palapa canopy is considered a hazard during weather conditions including tornadoes, hurricanes, and storms.

Accordingly, the inventors have developed a palapa canopy frame that is collapsible for storage, shipping and removal as necessary. The frame is stored and transported in a collapsed state and shipped to a work site, where it is installed with a canopy thatch cover. If necessary, the canopy including the cover and frame can be readily removed and collapsed for storage during hazardous weather conditions.

SUMMARY OF THE INVENTION

In a first embodiment a palapa canopy collapsible frame is disclosed comprising a cylindrical central support hub having an upper end and a lower end; a plurality of first frame members, each first frame member having a first end and a second end, the first end of each first frame member is pivotally connected to the upper end of support hub and the first ends are spaced circumferentially on the support hub. Each first frame member extends radially outward relative to the support hub, when the frame is in an expanded state. The palapa canopy collapsible frame further comprises a plurality of second frame members, each second frame member has a first end and a second end, the first end of each second frame member is pivotally connected to the lower end of the cylindrical central support hub wherein the first ends are spaced circumferentially on the support hub. Each second frame member extends radially outward relative to the support hub when the frame is in the expanded state. The second end of each second frame member is affixed to a respective first frame member at an attachment point when the canopy frame is in the expanded state. Further, a plurality of vertical posts are provided, and each vertical post is operatively connected to at least one of the first frame members when the canopy frame is in the expanded state. In an embodiment, each vertical post is operatively connected to a corresponding first frame member between the respective second ends of the first frame member and the attachment point.

In another embodiment an outdoor furniture system is disclosed comprising a plurality of spaced apart vertically disposed columns, a first unit with at least one vertically disposed column attached thereto, a second unit with at least one vertically disposed column attached thereto, and a collapsible canopy frame. The canopy frame further comprises a plurality of first frame members, each first frame member having a first end and a second end, the first end of each first frame member is pivotally connected to an upper end of a cylindrical central support hub wherein the first ends are spaced circumferentially on the support hub, and each first frame member extends radially outward relative to the support hub. The canopy frame also comprises a plurality of second frame members, each second frame member having a first end and a second end, and the first end of each second frame member is pivotally connected to a lower end of the support hub wherein the first ends are spaced circumferentially on the support hub, and each first frame member extends radially outward relative to the support hub. The second end of each second frame member is affixed to a respective first frame member at an attachment point when the canopy frame is in an expanded state. A plurality of vertical posts are also disclosed, each vertical post is operatively connected to at least one of the first frame members when the canopy frame is in the expanded state, and each vertical post is mounted to a top end of a corresponding column. In an embodiment, each vertical post is operatively connected to a corresponding first frame member between the respective second end of the first frame member and the attachment point.

A method of assembling an outdoor furniture system is also disclosed. The method of assembling an outdoor furniture system comprises extending a plurality of first frame members pivotally connected to an upper end of a cylindrical central support hub, each of the first frame members of the plurality of first frame members having a first end and a second end, and the first end being pivotally connected to the upper end of the support hub; extending a plurality of second frame member pivotally connected to the lower end of the cylindrical central support hub, each of the second frame members of the plurality of second frame members having a first end a second end; securing the second end of each second frame member to a corresponding first frame members at an attachment point; securing a plurality of vertical posts to a plurality of first members, wherein each vertical post is operatively connected to a corresponding first frame member between the second end of the first frame member and the attachment point; securing a plurality of cross bar members, wherein each cross bar member is affixed to a corresponding vertical post at one end of the cross bar member and to an adjacent first frame member at an opposing end of the cross bar member, wherein the adjacent first frame member is a next consecutive first frame member relative to the first frame member connected to the vertical post; and mounting each vertical post to a top end of at least one vertically disposed column, the at least one of the vertically disposed column attached to at least one of a first unit and a second unit. In an embodiment, each vertical post is operatively connected to a corresponding first frame member between the respective second ends of the first frame member and the attachment point.

BRIEF DESCRIPTION OF THE DRAWINGS

These and other advantages of the invention will become more apparent from the following description in view of the drawings. Similar structures illustrated in more than one figure are numbered consistently among the drawings.

DETAILED DESCRIPTION OF THE INVENTION

Figure 1:
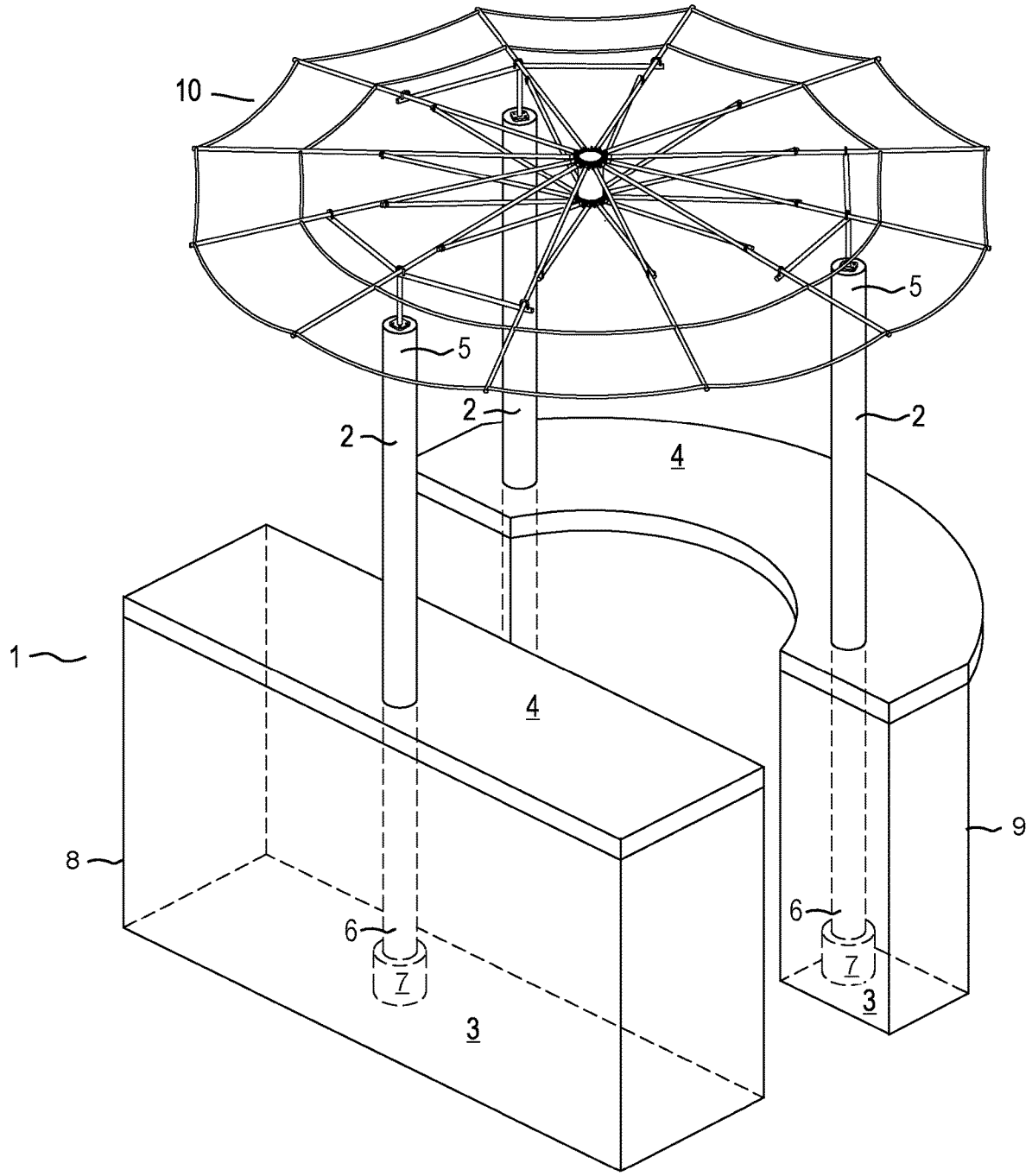
FIG. 1 is a perspective view of the inventive palapa canopy collapsible frame sitting atop columns of an outdoor furniture assembly in accordance with an embodiment of the present invention.

The inventor of the present invention has developed a novel apparatus used to support a palapa canopy by using a collapsible frame 10 that offers added structural integrity and rigidity while allowing the structure to be partially dismantled quickly and efficiently for transport or storage. The apparatus may comprise a series of first frame members 30 connected to a cylindrical central support hub 20 and supported by a plurality of second frame members 40. The apparatus may further comprise a series of support vertical post 50 to secure the apparatus in place. In an embodiment, the vertical posts 50 secure the apparatus to support columns 2 connected to an outdoor furniture system 1.

The outdoor furniture system 1 may further comprise a first unit 8 and a second unit 9. At least one of the first unit 8 and the second unit 9 may be at least one of a bar unit, an entertainment unit, and a cooking unit. In some embodiments, the bar unit may further comprise at least one a sink, a beverage dispensing system, a refrigeration unit, and a dishwasher. In yet some other embodiments, the entertainment unit may further comprise a television, a sound system, and a computer system. In still some other embodiments, the cooking unit may further comprise a grill, a stove, a burner, a pizza oven, a gas oven, and a charcoal grill.

For the purposes of promoting an understanding of the principles and operation of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to those skilled in the art to which the invention pertains.

It is important to an understanding of the present invention to note that all technical and scientific terms used herein, unless defined herein, are intended to have the same meaning as commonly understood by one of ordinary skill in the art. The techniques employed herein are also those that are known to one of ordinary skill in the art, unless stated otherwise. For purposes of more clearly facilitating an understanding of the invention as disclosed and claimed herein, the preceding definitions are provided. It is further noted that the terms "first," "second," and the like as used herein do not denote any order, quantity, or importance, but rather are used to distinguish one element from another. The terms "a" and "an" do not denote a limitation of quantity, but rather denote the presence of at least one of the referenced item. As used herein, the term "cable" will be understood to mean any wire, stranded wire, rope, or any strip of material whether braided, twisted, or twined capable of being used as a flexible support.

With respect to FIG. 1, a perspective view of the inventive palapa canopy collapsible frame 10 according to an embodiment of the present invention is shown. FIG. 1 illustrates an example of the palapa canopy collapsible frame 10 connected to an outdoor furniture system 1, including three support columns 2. The three support columns 2 extending from the lower surface 3 of the outdoor furniture system 1 through the upper surface 4 of the outdoor furniture system 1 to a height substantially above the upper surface 4. Each of the at least one support column 2 may have a top end 5 and a bottom end 6. In some embodiments, at least one receptacle 7 is affixed to at least one of the lower surface 3 and the upper surface 4 to receive at the bottom end 6 of the least one of the support columns 2. In other embodiments the support columns 2 is secured to the receptacle 7 using at least one of bonding, gluing, and fastening. As a non-limiting example at least one of the support columns 2 and the receptacles 7 may be fabricated out of wood, concrete, plastic, metal, or a combination thereof. It will be appreciated by those skilled in the art that the above described example is non-limiting and the inventive palapa canopy collapsible frame 10 may be connected to other types of support structures such as walls.

It will be noted that, for the purposes of clarity and simplicity, FIG. 1 is shown without the protective tarp and palm fronds typical of palapa thatching. However, according to an embodiment, the protective tarp is placed over and secured to palapa canopy collapsible frame 10, then the palm frond covering is draped over and securely attached to the protective tarp and the collapsible frame 10.

Figure 2:
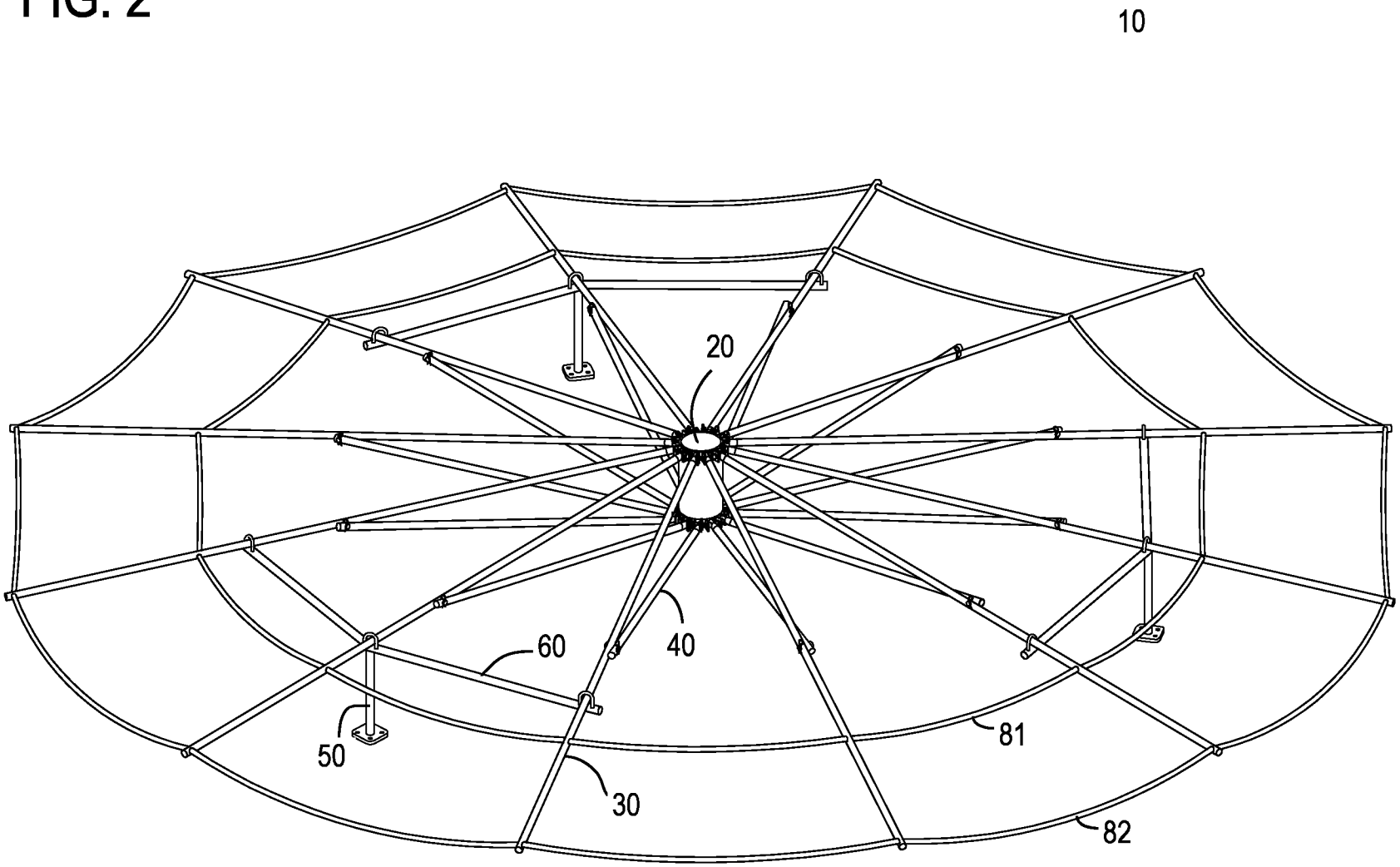
FIG. 2 is a perspective view of the inventive palapa canopy collapsible frame with cables, in accordance with an embodiment of the present invention.

With respect to FIG. 2, a perspective view of the palapa canopy collapsible frame 10 according to an embodiment, is illustrated. As shown, the collapsible frame 10 includes a cylindrical central support hub 20, a plurality of first frame members 30, a plurality of second frame members 40, a plurality of vertical posts 50, a first cable 81, and a second cable 82. As will be explained in more detail below, according to an embodiment, first frame members 30 and the second frame members 40 are pivotally connected to the cylindrical central support hub 20 to affect the collapsible nature of the collapsible frame 10.

Figure 3:
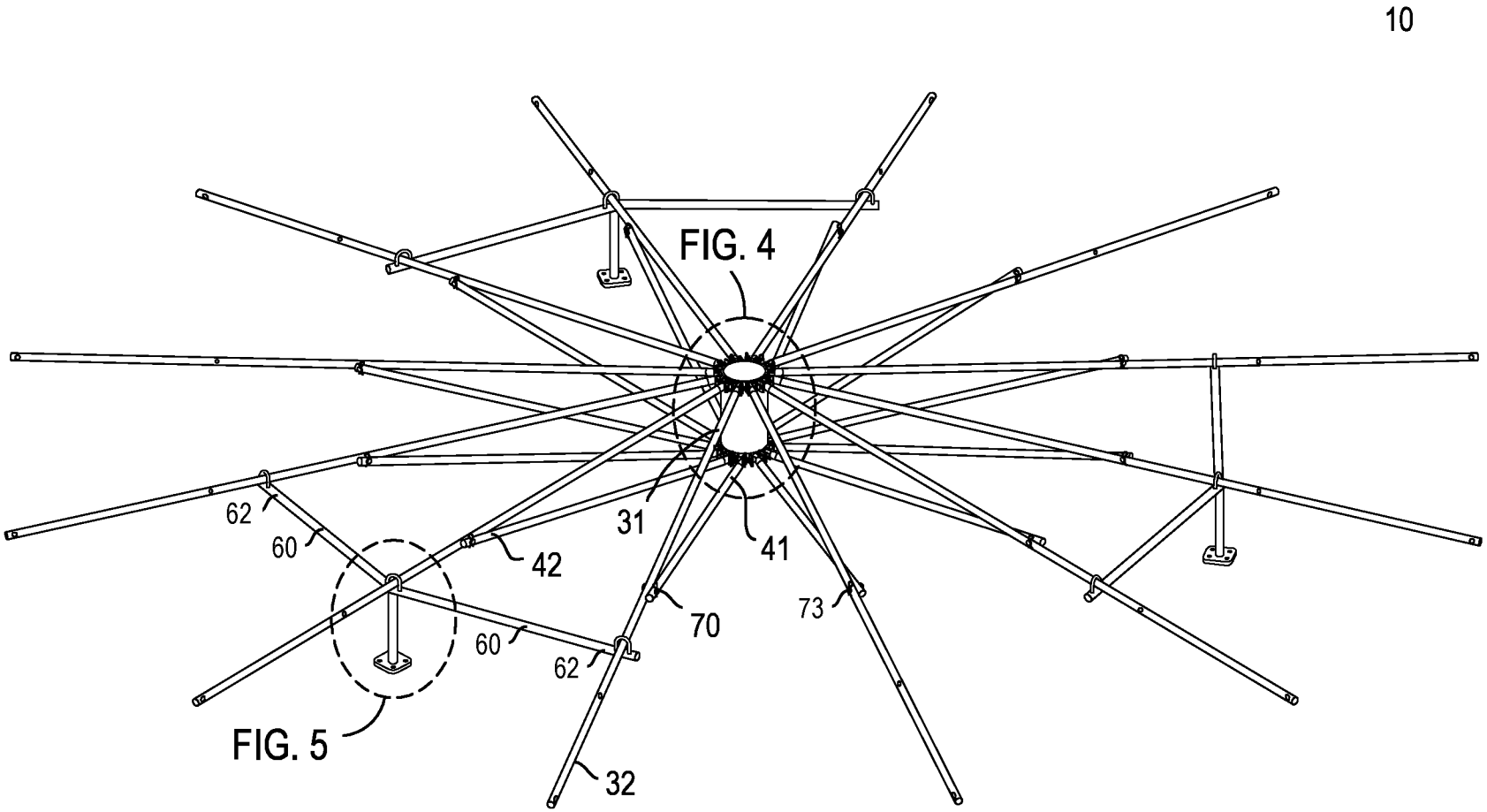
FIG. 3 is a perspective view of the inventive palapa canopy collapsible frame with the cables removed, in accordance with an embodiment of the present invention.

FIG. 3 shows another perspective view of the palapa canopy collapsible frame 10 according to an embodiment. However, in FIG. 3 the first cable 81 and the second cable 82 have been removed for illustration purposes. In an embodiment, each member of the plurality of first frame members 30 includes a first end 31 and a second end 32, and each member of the plurality of second frame members 40 may have a first end 41 and a second end 42.

Figure 4:
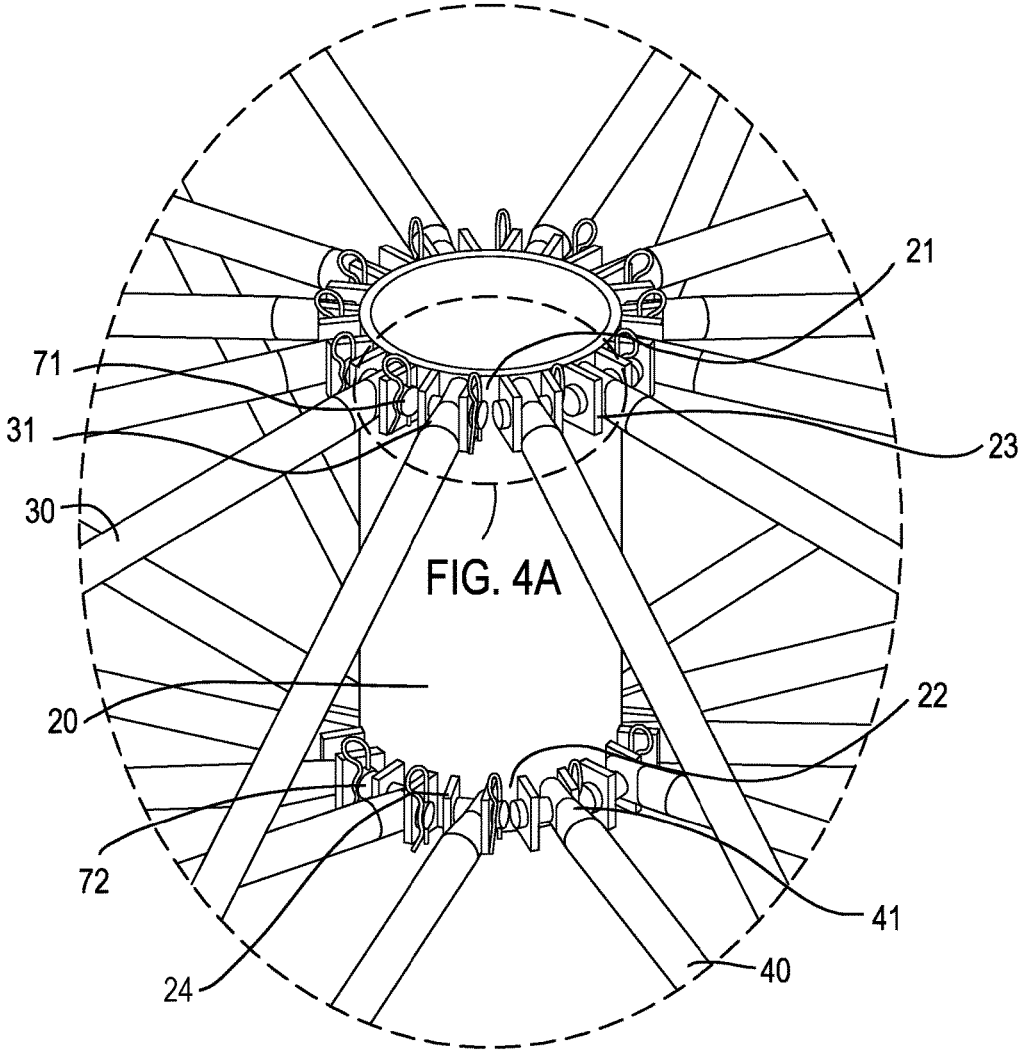
FIG. 4 is a detailed view of the cylindrical central support hub of the inventive palapa canopy collapsible frame, in accordance with an embodiment of the present invention.
Figure 4A:
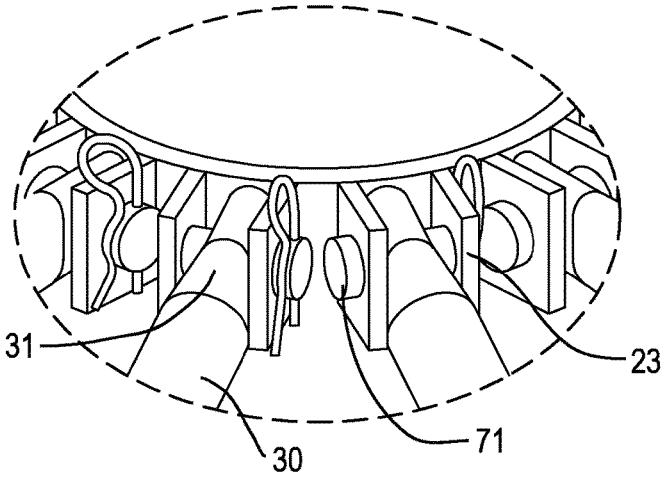
FIG. 4A is a detailed view of the upper end of the cylindrical central support hub of the inventive palapa canopy collapsible frame, in accordance with an embodiment of the present invention.
Figure 6:
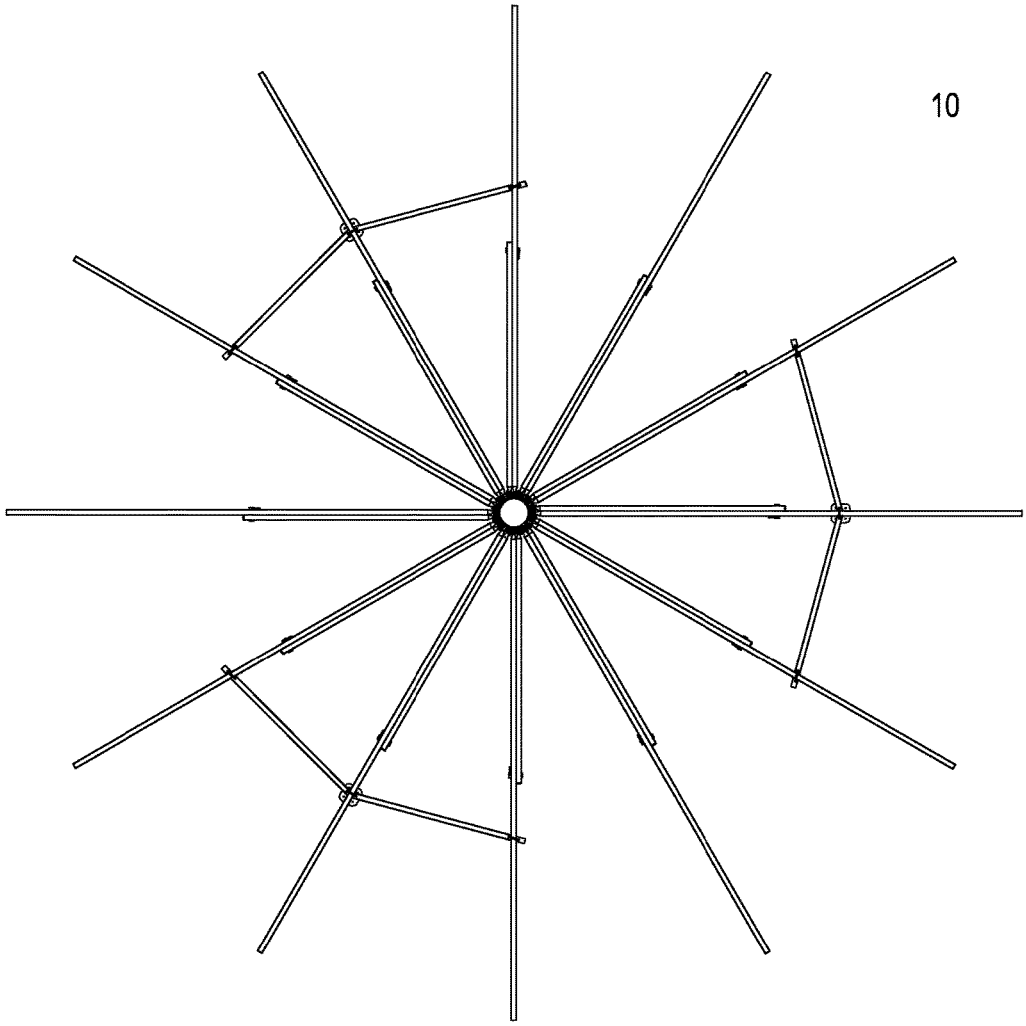
FIG. 6 is a top view of the inventive palapa canopy collapsible frame of FIG. 3, in accordance with an embodiment of the present invention.

With respect to FIG. 4, a detailed view of the cylindrical central support hub 20 of the inventive palapa canopy collapsible frame 10, in accordance with an embodiment of the present invention, is shown. In an embodiment, the central support hub 20 includes an upper end 21 and a lower end 22. Specifically, FIG. 4A shows a detailed view of the upper end 21 of the cylindrical central support hub 20 of the inventive palapa canopy collapsible frame 10, in accordance with an embodiment of the present invention. The first end 31 of each first frame member 30 is pivotally connected to the upper end 21 of the central support hub 20. The first end 31 may be pivotally connected to the upper end 21 of the central support hub 20 with a first fastener 71. It will be appreciated that the type of first fastener 71 is not essential and it may be achieved in a multitude of ways. As non-limiting examples, first fastener 71 could be a nut and bolt combination, a cotter pin, or a clevis pin and cotter pin combination. The upper end 21 may comprise a plurality of circumferentially spaced first connection points 23, which may also be referred to as brackets. Each first connection point 23 configured to receive the first end 31 of each first frame member 30 of the plurality of first frame members 30. It will be appreciated that the type of first connection point 23 is not essential an it may be achieved in a multitude of ways.

According to an embodiment, the first end 41 of each second frame member 40 is pivotally connected to the lower end 22 of the central support hub 20. According to another embodiment, the first end 41 is pivotally connected to the lower end 22 with a second fastener 72. It will be appreciated that the type of second fastener 72 is not essential and it may be achieved in a multitude of ways. As non-limiting examples, second fastener 72 could be a nut and bolt combination, a cotter pin, or a clevis pin and cotter pin combination. According to yet another embodiment, the lower end 22 comprises a plurality of circumferentially spaced second connection points 24. Each second connection point 24 is configured to receive the first end 41 of each second frame member 40 of the plurality second frame members 40.

Returning now to FIGS. 2 and 3, when the collapsible frame 10 is in an extended state the plurality of first frame members 30 and the plurality of the second frame members 40 extend radially outward relative to the central support hub 20. The second end 42 of each second frame member 40 is affixed to a respective first frame member 30 at a location between the first end 31 and the second end 32 of the respective first frame member 30 with a third fastener 73 at the attachment point 70, locking the first frame members 30 into position to support the protective tarp and the palm fronds covering. It will be appreciated that the type of third fastener 73 is not essential and it may be achieved in a multitude of ways. As non-limiting examples, third fastener 73 could be a nut and bolt combination, a cotter pin, or a clevis pin and cotter pin combination.

In an embodiment the collapsible frame 10 further includes a plurality of vertical posts 50. Each vertical post 50 is operatively connected to at least one of the first frame members 30 when the collapsible frame 10 is in the expanded state. In some non-limiting embodiments, there are at least three vertical posts 50 circumferentially spaced about the collapsible frame 10 and each vertical post 50 is operatively connected to a corresponding first frame member 30 at a point between the attachment point 70 and the second end 32 along the first frame 30 (illustrated in FIGS. 1-3, 5, and 6).

Figure 5:
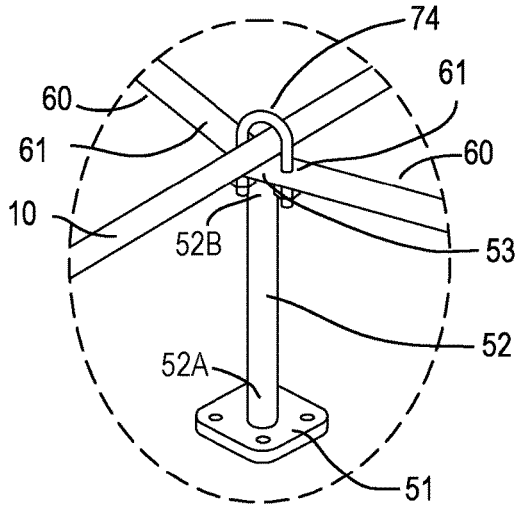
FIG. 5 is a detailed perspective view of two cross bar members attached to a vertical post wherein the fastener securing the two cross bar also secures a first frame member, in accordance with an embodiment of the present invention.

With regards to FIG. 5, a detailed perspective view of two cross bar members 60 attached to a vertical post 50 is shown. The vertical post 50, the two cross bar members 60, and a first frame member 30 are secured with a fourth fastener 74. It will be appreciated that the type of fourth fastener 74 is not essential and it may be achieved in a multitude of ways. As non-limiting examples, the fourth fastener 74 could be a u-shaped bolt and nut combination with a backing plate. The vertical post 50 is connected to the first frame member 30 between the second end 32 of the first frame member 30 and the attachment point 70 (the connection between the first frame member 30 and a second frame member 40 when the collapsible frame 10 is in the expanded state). The second end 62 of the cross bar member 60 is connected to an adjacent first frame member 30 at a place between the adjacent attachment point 70 (corresponding to the point where the second end 42 of the adjacent second frame member 40 is attached to the adjacent first frame member 30) and a second end 32 of the adjacent first frame member 30.

In an embodiment, vertical post 50 may comprise a base 51, a riser 52, and a coupler 53. The riser 52 including a first end 52A and a second end 52B. The first end 52A of riser 52 is securely connected to the base 51 and the second end 52B of the riser 52 is securely connected to the coupler 53. As a non-limiting examples, the base 51, the riser 52, and the coupler 53 are secured by welding, bonding, or using a fastener. In another embodiment, the vertical post 50 may be manufactured using an additive manufacturing method to create a single piece including the base 51, riser 52, and coupler 53.

Referring briefly to FIG. 1, in some embodiments, at least one support column 2 is attached to at least one of the first unit 8 or the second unit 9. The first unit 8 and the second unit 9 may also comprise at least one of the lower surface 3 and the upper surface 4. Each of the at least one support column 2 may have a top end 5 and a bottom end 6. The vertical posts 50 may be attached by securing the base 51 to the top end 5 of the support column 2 using at least one of screws, bolts, adhesives, cement, or any other method.

In yet another embodiment, each of the two cross bar members 60 secured to the vertical posts 50 include a first receiving portion with a recess at a first end 61 of each cross bar member 60. The first receiving portion is configured to receive a protrusion of the coupler 53 of the vertical post 50. As a non-limiting example, each of the two cross bar members 60 may be secured to the vertical posts 50 by at least one of welding, bonding, and fastening.

Figure 7:
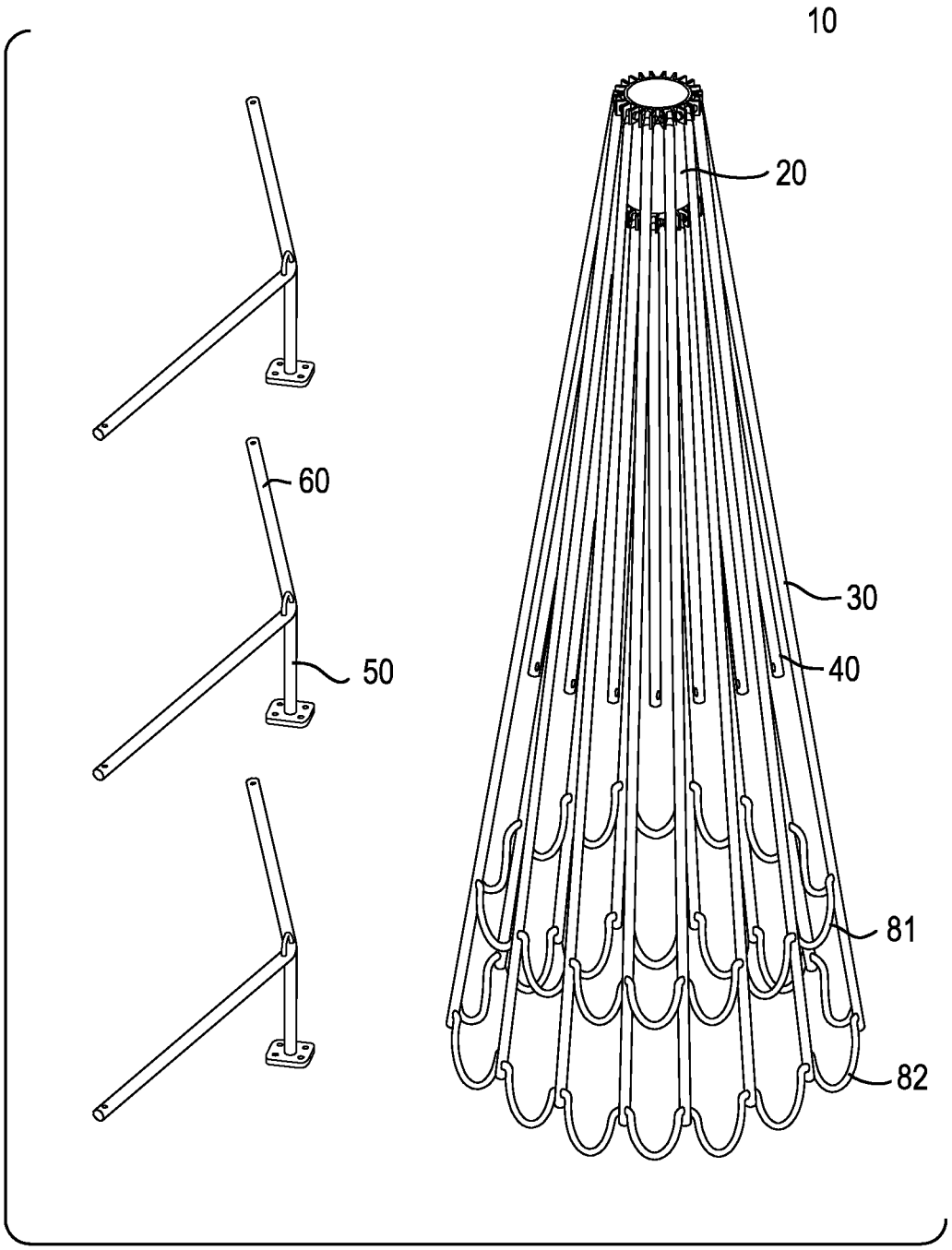
FIG. 7 is a perspective view of the inventive palapa canopy collapsible frame in the collapsed position, in accordance with an embodiment of the present invention.

With regards to FIG. 7, a perspective view of the inventive palapa canopy collapsible frame 10 is shown in the collapsed position, in accordance with an embodiment of the present invention. In an embodiment, the palapa canopy collapsible frame 10 is collapsed by removing the fourth fastener 74 and folding the plurality of first frame members 30 and second frame members 40 toward the center of the collapsible frame 10 thereby placing the first frame members 30 and second members 40 in a retracted position.

In an embodiment, the palapa canopy collapsible frame 10 is transported in a collapsed position where the plurality of first frame members 30 and the plurality of second frame members 40 are retracted toward the center of the collapsible frame 10. Preferably, the collapsible frame 10 is transported with the first cable 81 and the second cable 82 operatively connected to the first frame members 30.

The collapsible frame 10 is converted from a collapsed state to an extended state by first, placing the cylindrical central support hub 20 on a surface. Then, the plurality of first frame members 30 and each corresponding second frame member 40 are each pivoted to a respective extended position outwardly from the center of the cylindrical central support hub 20. The second frame members 40 are aligned with and attached to the first frame members 30 a point between first end 31 and the second end 32 of the first frame members 30 using a third fastener 73.

The plurality of vertical posts 50 are then secured to a plurality of first frame members 30 at a point between the second end 32 of the first frame member 30 and the point where the second end 42 of the second frame member 40 is secured to the first frame member 30 using a fourth fastener 74.

Then, two cross bar members 60 are attached to each of the vertical posts 50 at the respective first ends 61 of the two cross bar member 60. The second end 62 of the cross bar member 60 is connected to an adjacent first frame member 30 at a place between the adjacent attachment point 70 (corresponding to the point where the second end 42 of the adjacent second frame member 40 is attached to the adjacent first frame member 30) and a second end 32 of the adjacent first frame member 30.

Finally, the palapa canopy collapsible frame 10 is rotated so that the respective base 51 of the plurality of vertical post 50 attached to the plurality of first frame members 30 are in contact with the surface. By way of example, and as shown in FIG. 1, each vertical post 50 is mounted to a top end 5 of a respective support column 2 at the base 51 using known fastener or fastening mechanisms. The collapsible frame 10, now in an extended state, is then prepared to receive and support a canopy cover. While the invention is not so limited, the canopy cover includes a protective tarp and a palm frond covering.

As may be appreciated by those skilled in the art, the modular nature of the palapa canopy collapsible frame 10, specifically, and the outdoor furniture system 1, in general, allows for simplicity in the construction and disassembly of the system. The palapa canopy collapsible frame 10 and the outdoor furniture system 1 allow for a user to break them down quickly as may be necessary as inclement weather approaches or otherwise in hazardous weather conditions.

While the preferred embodiments of the present invention have been shown and described herein, it will be obvious that such embodiments are provided by way of example only. Numerous variations, changes and substitutions will occur to those of skill in the art without departing from the invention herein. Non-limiting examples include a component that is described above as being attached to one part of the apparatus may alternatively be attached to a different part of the apparatus in other embodiments. Parts described as being indirectly connected may be connected directly to each other, and vice versa. Component parts may be assembled from individual pieces or may be integrally formed as a single unit. Alternative types of connectors and alternative materials may be used. The apparatus may be used with other types of power tools. Accordingly, it is intended that the invention be limited only by the spirit and scope of the appended claims.

The invention claimed is:

1. A palapa canopy collapsible frame, comprising:

a cylindrical central support hub having an upper end and a lower end;

a plurality of first frame members, each first frame member having a first end and a second end, the first end of each first frame member is pivotally connected to the upper end of support hub, wherein the first ends are spaced circumferentially on the support hub, and each first frame member extends radially outward relative to the support hub when the frame is in an expanded state;

a plurality of second frame members, each second frame member having a first end and a second end, the first end of each second frame member is pivotally connected to the lower end of the cylindrical central support hub, wherein the first ends are spaced circumferentially on the support hub, and each second frame member extends radially outward relative to the support hub when the frame is in the expanded state;

wherein the second end of each second frame member is affixed to a respective first frame member at an attachment point when the canopy frame is in the expanded state; and, a plurality of vertical posts, each vertical post operatively connected to at least one of the first frame members when the canopy frame is in the expanded state;

wherein each of the plurality of vertical posts further comprises a base, a riser, and a coupler;

wherein each coupler of each vertical post further comprises a first protrusion and a second protrusion; and wherein each vertical post is connected to a first frame member between the second end of the first frame member and the attachment point; the vertical post is further connected to a first cross bar member and a second cross bar member; the first cross bar member and the second cross bar member each have a first end and a second end, and the first end of the first cross bar member is connected to the first protrusion of the coupler of the vertical post, and the first end of the second cross bar member is connected to the second protrusion of the coupler of the vertical post, the second end of the first cross bar member is connected to a first adjacent first frame member between the second end of the adjacent first frame member and a respective first adjacent attachment point, and the second end of the second cross bar member is connected to a second adjacent first frame member between the second end of the second adjacent frame member and a respective second adjacent attachment point.

2. The palapa canopy collapsible frame of claim 1, wherein the attachment point is a location between the first and second ends of the respective first frame member of the plurality of first frame members.

3. An outdoor furniture system, comprising:

a plurality of spaced apart vertically disposed columns;

a first unit with at least one of the plurality of spaced apart vertically disposed columns attached thereto;

a second unit with at least one of the plurality of spaced apart vertically disposed columns attached thereto; and a collapsible canopy frame, wherein the canopy frame comprises:

a plurality of first frame members, each first frame member having a first end and a second end, the first end of each first frame member is pivotally connected to an upper end of a cylindrical central support hub, wherein the first ends are spaced circumferentially on the support hub, and each first frame member extends radially outward relative to the support hub;

a plurality of second frame members, each second frame member having a first end and a second end, the first end of each second frame member is pivotally connected to a lower end of the support hub, wherein the first ends are spaced circumferentially on the support hub, and each second frame member extends radially outward relative to the support hub;

wherein the second end of each second frame member is affixed to a respective first frame member at an attachment point when the canopy frame is in an expanded state; and, a plurality of vertical posts, each vertical post is operatively connected to at least one of the first frame members when the canopy frame is in the expanded state, and each vertical post is mounted to a top end of a corresponding vertically disposed column;

wherein each of the plurality of vertical post further comprises a coupler;

wherein each coupler of each vertical post further comprises a first protrusion and a second protrusion; and wherein each vertical post is connected to a first frame member between the second end of the first frame member and the attachment point; the vertical post is further connected to a first cross bar member and a second cross bar member; the first cross bar member and the second cross bar member each have a first end and a second end, and the first end of the first cross bar member is connected to the first protrusion of the coupler of the vertical post, and the first end of the second cross bar member is the first cross bar member is connected to a first adjacent first frame member between the second end of the adjacent first frame member and a respective first adjacent attachment point, and the second end of the second cross bar member is connected to a second adjacent first frame member between the second end of the second adjacent frame member and a respective second adjacent attachment point.

4. The outdoor furniture system of claim 3, wherein the attachment point is a location between the first and second ends of the respective first frame member of the plurality of first frame members.

5. The outdoor furniture system of claim 3, wherein at least one of the first unit and the second unit is at least one of a bar unit, an entertainment unit, and a cooking unit.

6. A method of assembling an outdoor furniture system, the method comprising:

extending a plurality of first frame members pivotally connected to an upper end of a cylindrical central support hub, each of the first frame members of the plurality of first frame members having a first end and a second end, the first end being pivotally connected to the upper end of the support hub;

extending a plurality of second frame members pivotally connected to the lower end of the cylindrical central support hub, each of the second frame members of the plurality of second frame members having a first end and a second end;

securing the second end of each second frame member to one of the first frame members of the plurality of first frame members at an attachment point;

securing a plurality of vertical posts to the plurality of first frame members, wherein each vertical post is operatively connected to a corresponding first frame member between the second end of the first frame member and the attachment point;

securing a plurality of cross bar members, wherein a receiving portion of each cross bar member is affixed to a respective protrusion of a coupler of a corresponding vertical post at one end of the cross bar member and to an adjacent first frame member at an opposing end of the cross bar member, where the adjacent first frame member is a next consecutive first frame member relative to the first frame member connected to the vertical post; and mounting each vertical post to a top end of a respective vertically disposed column, each respective vertically disposed column being attached to one of a first unit and a second unit.

7. The method of assembling an outdoor furniture system of claim 6, wherein the attachment point is a location between the first and second ends of the respective first frame member of the plurality of first frame members.

8. The method of assembling an outdoor furniture system of claim 6, wherein at least one of the first unit and the second unit is at least one of a bar unit, an entertainment unit, and a cooking unit.

* * * * *